US007103923B2

(12) United States Patent
Picotte

(10) Patent No.: US 7,103,923 B2
(45) **Date of Patent: *Sep. 12, 2006**

(54) HEAD PROTECTOR FOR INFANTS, SMALL CHILDREN, SENIOR CITIZENS, ADULTS OR PHYSICALLY DISABLED INDIVIDUALS

(76) Inventor: Brooke Picotte, 111-07 76th Ave., Forest Hills, NY (US) 11375

( * ) Notice: Subject to any disclaimer, the term of this patent is extended or adjusted under 35 U.S.C. 154(b) by 0 days.

This patent is subject to a terminal disclaimer.

(21) Appl. No.: 10/611,033

(22) Filed: Jul. 1, 2003

(65) Prior Publication Data

US 2004/0107482 A1 Jun. 10, 2004

Related U.S. Application Data

(63) Continuation-in-part of application No. PCT/US02/25256, filed on Aug. 7, 2002.

(60) Provisional application No. 60/483,995, filed on Jul. 1, 2003.

(51) Int. Cl.
*A42B 1/22* (2006.01)
*A61F 5/00* (2006.01)

(52) U.S. Cl. ..... 2/412; 2/414; 2/171; 602/17

(58) Field of Classification Search ..... 2/411, 2/412, 413, 414, 410, 171, 909, 171.2, DIG. 3; 602/17

See application file for complete search history.

(56) References Cited

U.S. PATENT DOCUMENTS 1,072,321 A * 9/1913 Fitch ..... 2/413
2,289,345 A * 7/1942 Craig et al. ..... 2/410
2,969,547 A * 1/1961 Dye ..... 2/411
3,039,109 A * 6/1962 Simpson ..... 2/413
3,047,879 A * 8/1962 Spreiregen ..... 2/181
3,197,784 A * 8/1965 Carlisle ..... 2/420
3,208,080 A * 9/1965 Hirsch ..... 2/414
3,478,365 A * 11/1969 Varga ..... 2/424
3,577,562 A * 5/1971 Holt ..... 2/414
3,713,640 A * 1/1973 Margan ..... 267/117
3,843,970 A * 10/1974 Marietta et al. ..... 2/415
3,916,446 A * 11/1975 Gooding ..... 2/421
4,354,284 A * 10/1982 Gooding ..... 2/413
4,581,773 A 4/1986 Cunnane
4,646,367 A 3/1987 El Hassen
4,663,785 A 5/1987 Comparetto (Continued)

FOREIGN PATENT DOCUMENTS

DE 4024957 A1 * 2/1992

(Continued)

OTHER PUBLICATIONS

Expert Pages, A New Standard of Care in Absorbing and Dissipating Forces, by Dr. Carl J. Abraham, P.E., Jun. 24, 2003.

(Continued)

*Primary Examiner*—Rodney Lindsey
(74) *Attorney, Agent, or Firm*—Alston & Bird LLP

(57) ABSTRACT

The present invention is directed to a protective hat suitable for every day wear by infants, children, senior citizens or physically disabled individuals. Such hat protects at least the sides, top or rear of the wearer's head from injuries due to falls or bumps against hard objects while conducting routine, daily activities. Generally, the head protector of the present invention may comprise: (1) a cap member: and (2) one or more flexible, resilient shock absorbent pads. The cap member may be constructed so as to fully enclose and/or encapsulate the one or more pads.

9 Claims, 7 Drawing Sheets

U.S. PATENT DOCUMENTS

| | | | | | |
|---|---|---|---|---|---|
| 4,745,637 | A | | 5/1988 | Steele | |
| 5,075,903 | A | * | 12/1991 | Richoux | 2/411 |
| 5,351,343 | A | | 10/1994 | Harbison | |
| 5,437,064 | A | * | 8/1995 | Hamaguchi | 2/414 |
| 5,437,618 | A | | 8/1995 | Sikes | |
| 5,539,020 | A | | 7/1996 | Bracken et al. | |
| 5,544,367 | A | * | 8/1996 | March, II | 2/410 |
| 5,581,818 | A | * | 12/1996 | Lorenzi et al. | 2/411 |
| 5,729,830 | A | * | 3/1998 | Luhtala | 2/2.5 |
| 5,745,923 | A | * | 5/1998 | Katz | 2/411 |
| 5,768,715 | A | * | 6/1998 | Gregg et al. | 2/411 |
| 5,882,205 | A | | 3/1999 | Peterson | |
| 5,930,841 | A | * | 8/1999 | Lampe et al. | 2/411 |
| 6,142,786 | A | | 11/2000 | Culberson et al. | |
| 6,240,570 | B1 | * | 6/2001 | Wu | 2/410 |
| 6,247,181 | B1 | | 6/2001 | Hirsch et al. | |
| 6,263,515 | B1 | * | 7/2001 | Turner et al. | 2/410 |
| 6,292,952 | B1 | * | 9/2001 | Watters et al. | 2/411 |
| 6,325,023 | B1 | | 12/2001 | Elnatan | |
| 6,360,376 | B1 | * | 3/2002 | Carrington | 2/412 |
| 6,453,477 | B1 | | 9/2002 | Bainbridge et al. | |
| 6,467,099 | B1 | * | 10/2002 | Dennis et al. | 2/455 |
| 6,480,698 | B1 | | 11/2002 | Ho et al. | |
| 6,493,881 | B1 | * | 12/2002 | Picotte | 2/413 |
| 6,532,602 | B1 | * | 3/2003 | Watters et al. | 2/411 |
| 6,704,943 | B1 | * | 3/2004 | Calonge Clavell | 2/411 |
| 2003/0070209 | A1 | * | 4/2003 | Falone et al. | 2/412 |
| 2003/0077407 | A1 | | 4/2003 | Chang | |
| 2004/0034903 | A1 | * | 2/2004 | Blair | 2/411 |

FOREIGN PATENT DOCUMENTS

| | | | | |
|---|---|---|---|---|
| DE | 4240643 | A1 | * | 1/1994 |
| JP | 04194005 | A | * | 7/1992 |

OTHER PUBLICATIONS

Total Bike, New Advancements in Helmet Materials Make Them Safer Than Ever, http://www/totalbike/com/news/article/608/ (Jan. 6, 2002).

W Helmets with Zorbium Foam, http://www.outdoorreview.com/pscSnowboard,Equiment/Helmets,and,Goggles/Helmets/...

SIA Snow Sports Industries Americas, Helmets Get Lighter and Add Better Venting and Fit Systems; www.snowsports.org (winter 2003-04).

wisdomking.com; http://www.wisdomking.com/line 220070.html © 2003.

wisdomking.com; http://www.wisdomking.com/line 220070.html?off=26&n=c220070 © 2003.

wisdomking.com; http://www.wisdomking.com/line 220070.html?off-51&n=c220070%00c220070 © 2003.

Stardust, Aerogel Quick Facts;http://stardust.jpl.nasa.gov/tech/aerogel.html last updated Mar. 14, 2003.

Ernest Orlando Lawrence Berkeley National Laboratory, Silica Aerogels; http://eande.lbl.gov/ECS/aerogels/satoc.htm.

Ernest Orlando Lawrence Berkeley National Laboratory, A Brief History of Silica Aerogels; http://eande.lbl.gov/ECS/aerogels/sahist.htm.

Ernest Orlando Lawrence Berkeley National Laboratory, How Silica Aerogels Are Made, http://eande.lbl.gov/ECS/aerogels/saprep.htm.

Ernest Orlando Lawrence Berkeley National Laboratory, The Surface Chemistry of Silica Aerogels http://eande.lbl.gov/ECS/aerogels/saschem.htm.

Ernest Orlando Lawrence Berkeley National Laboratory, The Pore Sturcture of Silica Aerogel http://eande.lbl.gov/ECS/aerogels/sapore.htm.

Medscape Medical News; First Guidelines for Treatiment of Pediatric Traumatic Brain Injury CME; Release Date: Jun. 19, 2003. News Author: Laurie Barclay, MD; CME Author: Charles Vega, MD.

* cited by examiner

HEAD PROTECTOR FOR INFANTS, SMALL CHILDREN, SENIOR CITIZENS, ADULTS OR PHYSICALLY DISABLED INDIVIDUALS

I. CROSS REFERENCE TO RELATED APPLICATION

This application is a continuation-in-part of PCT/US02/25256, filed Aug. 7, 2002, which claims priority from U.S. application Ser. No. 09/924,425 filed Aug. 7, 2001, now U.S. Pat. No. 6,493,881. This application is also co-pending with U.S. application Ser. No. 60/483,995, entitled "Protective Padding," field Jul. 1, 2003. Each of the above-mentioned related applications are incorporated herein by reference in their entirety.

II. BACKGROUND OF THE INVENTION

Infants, small children, physically disabled adults and seniors are especially susceptible to banging their heads on hard surfaces due to falls or slips while conducting daily, routine activities. The typical infant or small child will sustain multiple falls on hard surfaces before it can learn to sit, crawl or walk. For example, infants often crawl beneath chairs and tables. While underneath these items, the child will bang her head when attempting to stand up or lift her head. While the resulting injuries are not life threatening, they cause swelling and bruising about the head. Moreover, the bang or bump to the head is quite traumatic, causing the child to cry or become agitated.

Small children capable of walking or running are particularly vulnerable to falls against table corners, walls and other hard, pointed surfaces. In some instances, serious head injuries can result when a child bangs his or her head against any of these items. Indeed, head trauma is a common accident in childhood. It has been reported that such accidents account for 600,000 emergency room visits per year in the U.S. Most cases of pediatric head trauma do not require intervention or result in negative sequelae. However, in developed countries, brain injury remains one of the most common causes of death and disability in childhood. Further, children or adults who are disabled, developmentally delayed or who suffer from neuro motor or muscular/skeletal impairments often have difficulty standing and/or walking independently, or accomplishing everyday activities. Such individuals are also susceptible to head injuries due to falls or slips.

Much of the protective headgear currently available for infants, children and adults is neither fashionable, comfortable nor effective. Many are usually bulky and restrictive. Also, most of the current protective headgear is not enjoyable to wear, nor is it designed for use in the house during daily activities such as walking, playing, crawling, or learning to walk, nor are they designed for daily, non-sport activities such as playing in a playground. Much of the protective headgear is designed for outdoor athletic or sport activities, such as soccer, baseball and other contact sports, and is not suitable for everyday wear.

The present invention overcomes the problems of currently available protective headgear by providing a head protector that is attractive, comfortable and effectively provides an infant, child or adult head protection for extended periods of time in a fun, enjoyable manner. The present invention may be worn daily by an individual during ordinary indoor or outdoor activities, including but not limited to, crawling, walking, playing (e.g., playing in a playground), non sport activities, and other activities. The present invention is particularly suitable in any non-sport environment.

The present invention may also be suitable for senior citizens. Many seniors fear falling while conducting daily, routine activities. The protective hat of the present invention may be utilized by seniors to reduce the risk of head injury during a fall and to alleviate the fear of falling while they conduct daily activities.

The present invention may also be adapted to protect an individual from self mutilation injuries to the head. For example, it is known that some autistic children are prone to self mutilation activities such as head banging. Some children with Attention Deficit Disorder are more prone to accidents and injuries due to impulsivity and thus require more protection from falls and bangs against hard objects.

III. SUMMARY OF THE INVENTION

Accordingly, it is an object of the present invention to provide a head protector for infants and small children and adults.

It is a further object of the present invention to provide a head protector which is lightweight and comfortable to wear and will not interfere with the wearer's activities.

It is a further object of the present invention to provide a head protector that is suitable to wear while performing everyday activities in home or work environment.

It is a further object of the present invention to provide a head protector that is enjoyable to wear by an infant or small child or adult during their daily activities, including but not limited to daily indoor or outdoor activities.

It is a further object of the present invention to provide a head protector that is suitable to wear during non sport, everyday activities.

It is a further object of the present invention to provide a head protector that is configured to provide protection to at least the sides, top or rear of the wearer's head.

It is a further object of the present invention to provide a head protector that is configured to provide protection in work environments where there is a risk of minor head injury due to bangs against objects such as, for example, low hanging pipes or machinery or fall due to slippery or obstructed walkways.

Other objects and advantages of the invention will become apparent upon reading the following detailed description and upon reference to the following drawings.

IV. BRIEF DESCRIPTION OF THE DRAWINGS

For a further understanding of the nature and objects of the present invention, reference should be made to the following detailed non-limiting description, taken in conjunction with the accompanying drawings, wherein.

Figure 1:
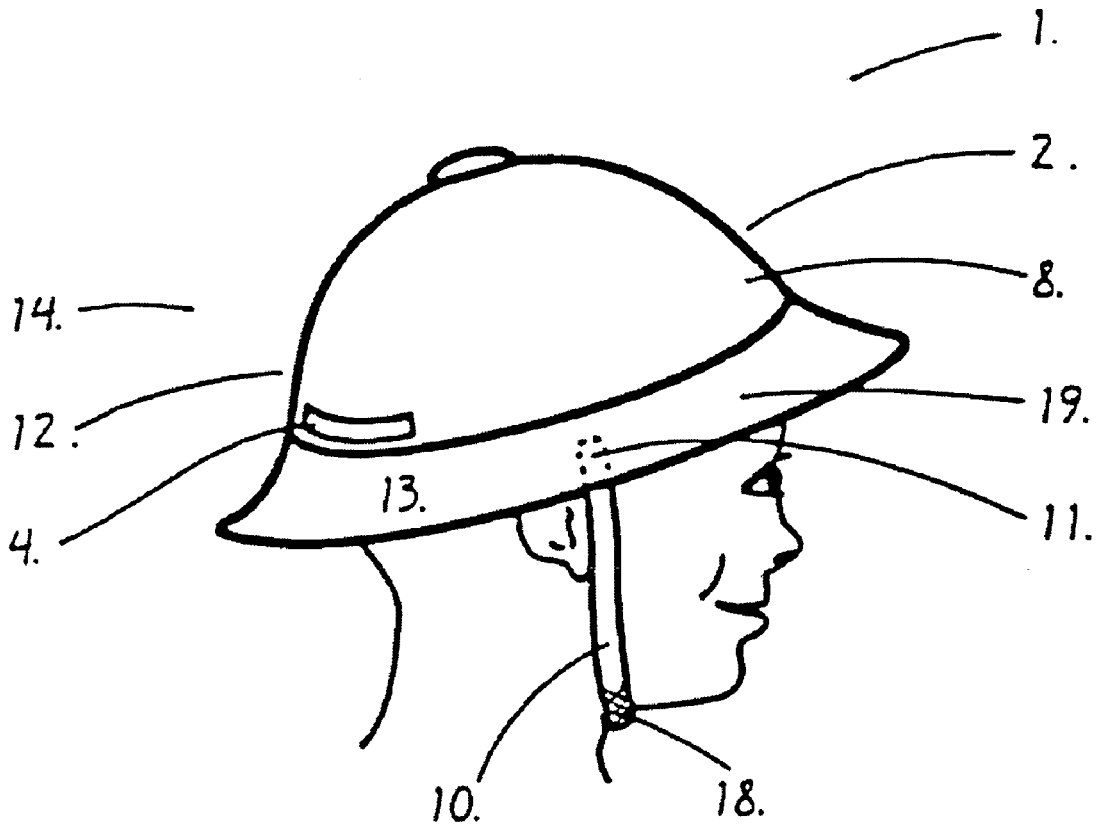
FIG. 1 is a side perspective view of an alternative embodiment of the head protector of the present invention.
Figure 2:
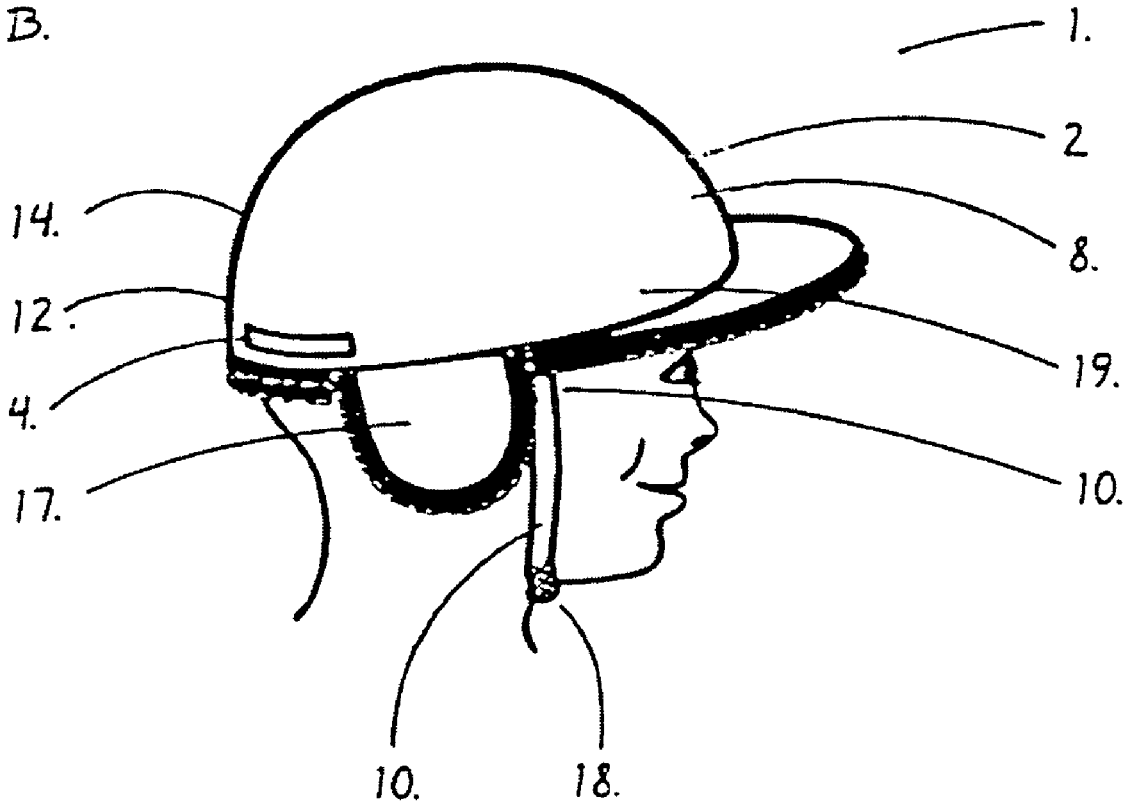
FIG. 2 is a side perspective view of another alternative embodiment of the head protector of the present invention.
Figure 3:
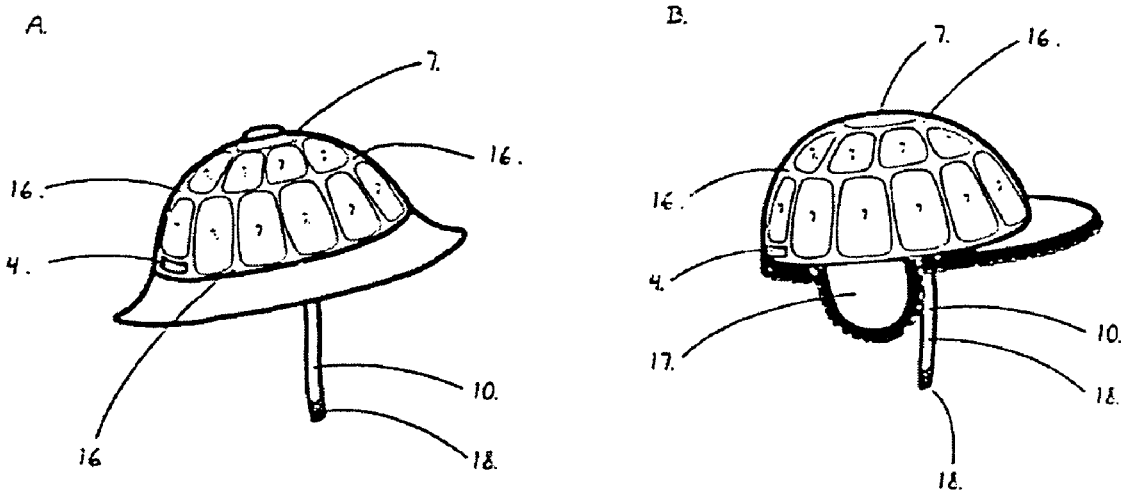

FIG. 3*a* and FIG. 3*b* represent a side perspective view of the embodiments of FIG. 1 and FIG. 2, respectively, illustrating a possible assembly of the fluid-containing pads utilized in the construction of the present invention, and an alternative head strap.

Figure 4:
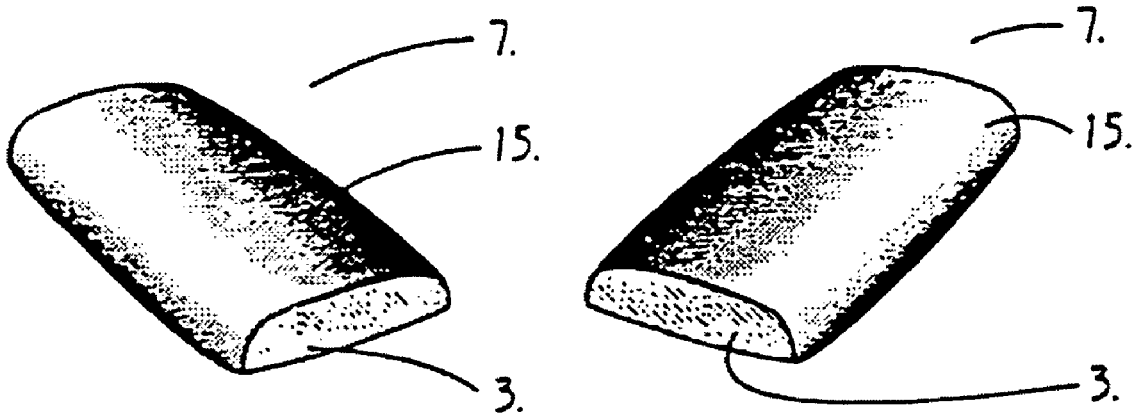

FIG. 4 is a cross sectional view of a non-limiting embodiment of fluid-containing pad utilized in the construction of the present invention.

Figure 5:
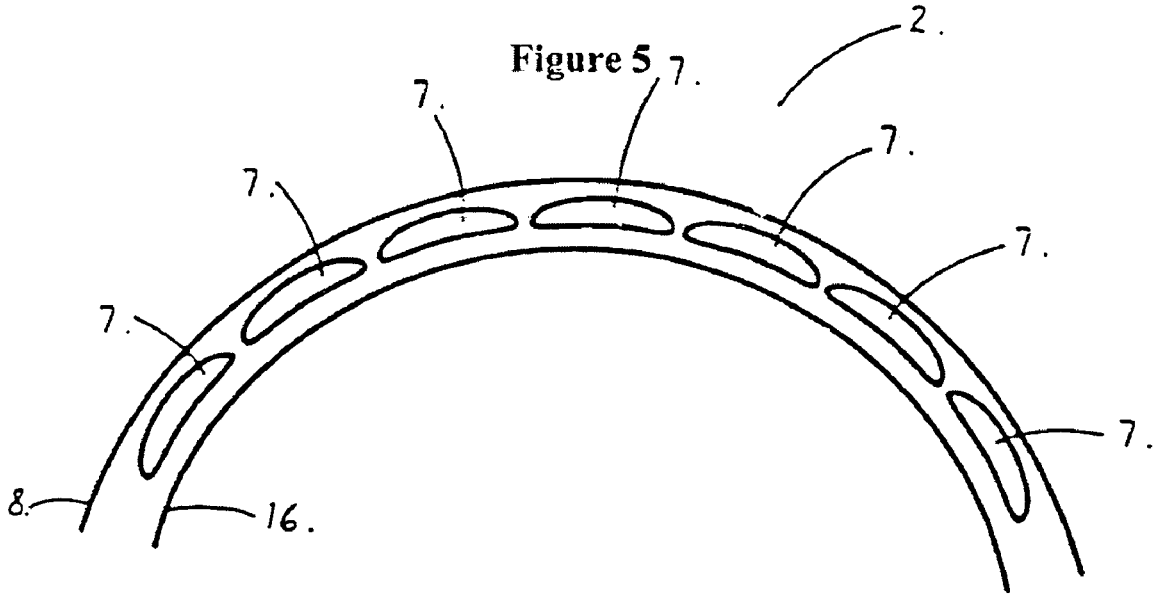

FIG. 5 is a cross-sectional view of a cap member utilized in the construction of the present invention.

Figure 6A:
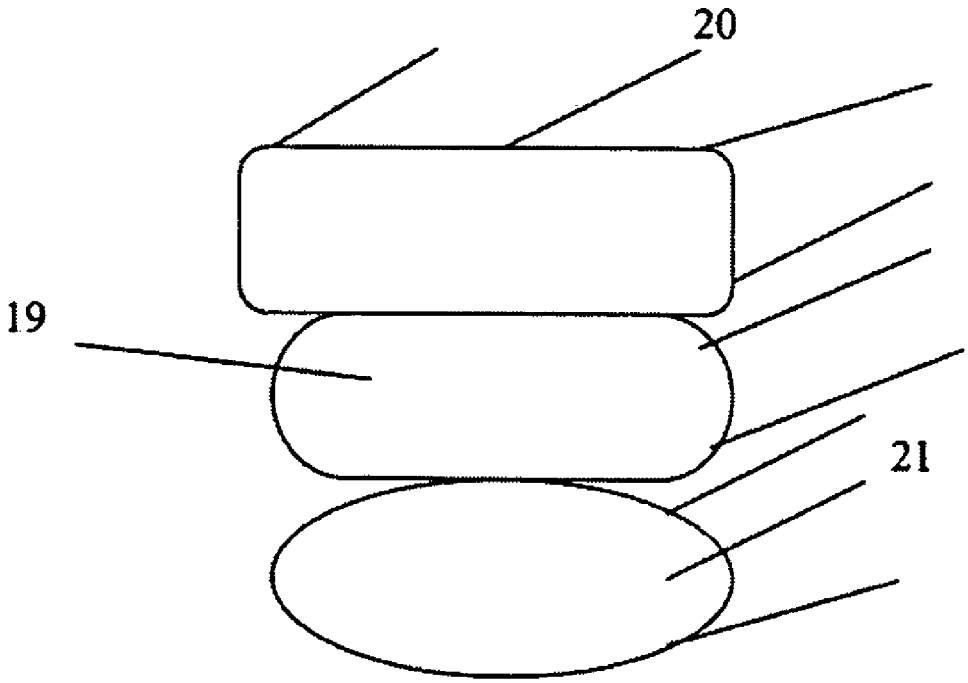

FIG. 6*a* is a side perspective view of a padded sandwich utilized in the construction of the present invention.

Figure 6B:
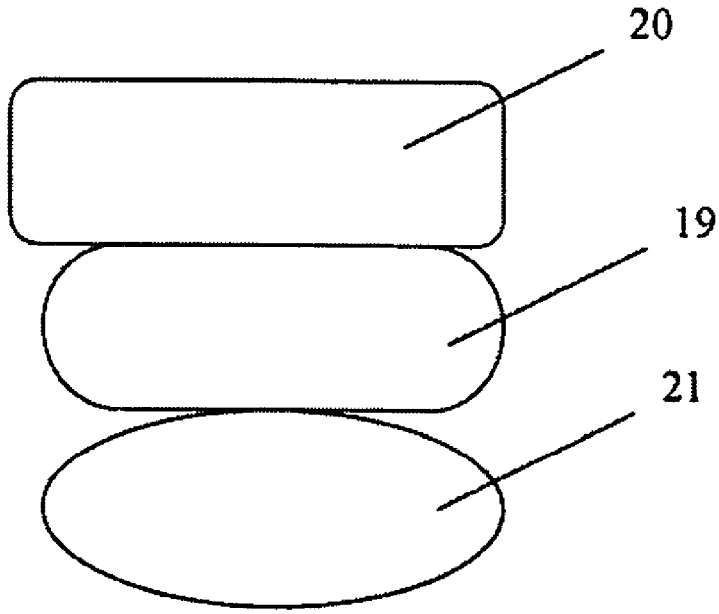

FIG. 6*b* is a cross-sectional view of a padded sandwich utilized in the construction of the present invention.

Figure 6C:
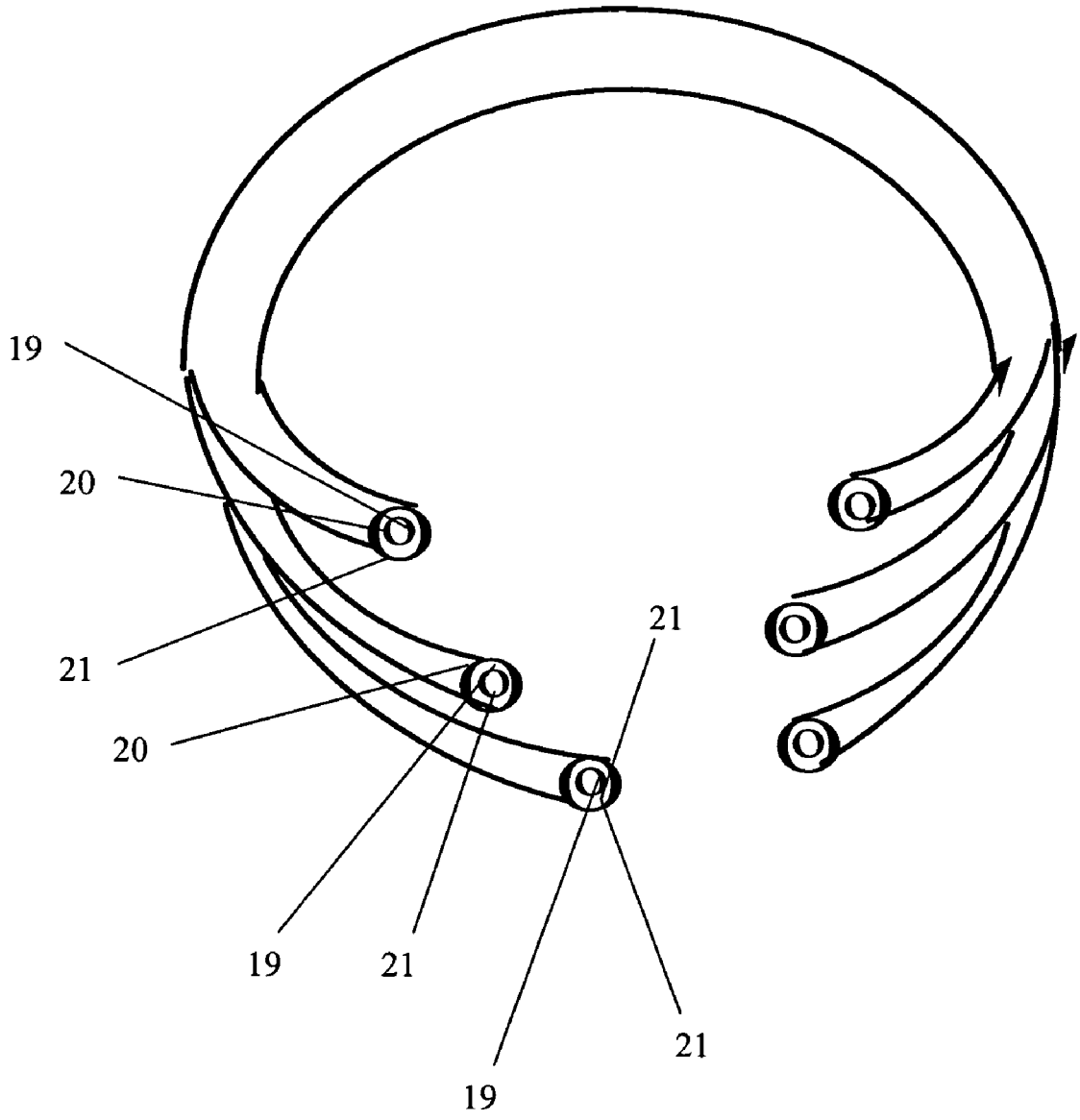

FIG. 6*c* is a cross-sectional view of an exemplary protective pad assembly of the present invention.

DETAILED DESCRIPTION OF THE INVENTION

In one alternative embodiment, the present invention is directed to a head protector suitable to be worn by an infant or small child or adult during indoor and outdoor activities, including for example, crawling, walking, or playing, and other activities. With reference to the accompanying figures, head protector (1) may comprise a cap member (2). The cap member (2) may be shaped so that it encircles at least the entire upper portion of a wearer's head, or a substantial portion thereof, when worn. The cap member (2), when worn, may overlie and protect at least the sides, the top or the rear portion of the wearer's head. The cap member may further comprise one or more pads to protect one or more portion's of the wearer's head. It should be understood that the pads may be used alone or in conjunction with a cap member.

A. Padded Materials

In the present invention, the one or more pads may comprise a variety of materials, as discussed herein. In one alternative embodiment of the present invention, the one or more pads can be inflated or filled with various mediums, so long as the medium is compatible with the material used in making the pad. Any medium can be used to fill the pad. For example, such medium may include a gas or liquid or a semi-solid or gel. In one alternative embodiment, material for filling the pad may be a gel, e.g., a silicone gel. The pad can alternatively be filled with silica aerogel or air, a mixture of gases, or a single gas, e.g., air or nitrogen. Other gels may include ultra light, shock-absorbing gel with low deflection. Preferably, nonflammable and non-toxic mediums should be used. Alternatively, a liquid can be used to fill the pad, e.g., water, saline, or other non-aqueous liquid compatible with the pad material. The liquid can be of a viscosity ranging from that approximating water to an aerosol, semi-solid, or other gel-like material. In addition, a solid, e.g., foam rubber or other resilient material, can be used so long as the desired cushioning effect is produced.

In one alternative embodiment, the pad of the present invention may be filled with an aerogel (e.g. silica aerogel). The aerogel may have one or more of the following characteristics in Table 1. Generally, aerogel is not like conventional foams, but is a special porous material with extreme microporosity on a micron scale. It is composed of individual features only a few nanometers in size, in most cases. These may be linked in a highly porous dendritic-like structure.

TABLE I

Physical Properties of Aerogels (e.g. Silica Aerogels)

| Property | Value | Comments |
|---|---|---|
| Apparent Denisty | 0.003–0.35 g/cm$^3$ | Most common density is ~0.1 g/cm$^3$ |
| Internal Surface Area | 600–1000 m$^2$/g | As determined by nitrogen adsorption/desorption |

TABLE I-continued

Physical Properties of Aerogels (e.g. Silica Aerogels)

| Property | Value | Comments |
|---|---|---|
| % Solids | 0.13–15% | Typically 5% (95% free space) |
| Mean Pore Diameter | ~20 nm | As determined by nitrogen adsorption/desorption (varies with density) |
| Primary Particle Diameter | 2–5 nm | Determined by electron microscopy |
| Index of Refraction | 1.0–1.05 | Very low for a solid material |
| Thermal Tolerance | To 500 C. | Shrinkage begins slowly at 500 C., increases with inc. temperature. Melting point is >1200 C. |
| Coefficient of Thermal Expansion | 2.0–4.0 × 10$^{-}$ 6 | Determined using ultrasonic methods |
| Poisson's Ratio | 0.2 | Independent of density. Similar to dense silica. |
| Young's Modulus | 10$^6$ – 10$^7$ N/m$^2$ | Very small (<10$^4$×) compared to dense silica |
| Tensile Strength | 16 kPa | For density = 01 g/cm$^3$ |
| Fracture Toughness | ~0.8 kPa*m$^{1/2}$ | For density = 0.1 g/cm$^3$. Determined by 3-point bending. |
| Dielectric Constant | ~1.1 | For density = 0.1 g/cm$^3$. Very low for a solid material. |
| Sound Velocity Through the Medium | 100 m/sec | For density = 0.7 g/cm$^3$. One of the lowest velocities for a solid material. |

Other suitable padding for the present invention includes foam. Such foam may comprise a stable, chemically inert, impact resistant material. The foam may also comprise a closed-cell foam or opened-cell foam. It may be a cross-linked polymer such as high density or low density polyethylenene foam (e.g. ForeBloc®). Other foams may include those capable of withstanding repeated impact, and having a density between about 2.0 and 8.0 lbs./cu. ft. Another suitable foam includes Zorbium Foam®) or other "hard foam" that is capable of absorbing impact through energy dissipation. In one alternative embodiment, the foam layer may have a thickness of about ⅛ to about 4 inches, or about ¼ to about ⅜ inches. In another alternative embodiment, the protective hat of the present invention may comprise foam (alone) or in combination with any other padding material described herein. For example, foam padding and gel padding may be interspersed uniformly or non-uniformly in the protective hat.

In the present invention, the foam may be molded, die-cut or cut with any other suitable technique. They may vary in thickness from about ½ inch to a full inch. The foam may vary in density from 1.0 pound per cubic foot to 9.0 pounds per cubic foot. In one embodiment, closed-cell foam from about pound per cubic inch in density, 3⁄16" thick, up to 9 pounds per cubic foot, also 3⁄16 inches thick. In one preferred embodiment, the more-dense foam may be placed in the area of likely impact, and the less dense foam away from that area.

Suitable padding for the present inventions also disclosed in U.S. Pat. No. 6,453,477, which is incorporated herein by reference in its entirety. In this paten, for example, the pads may include outer casings of porous, breathable, inelastic material overfilled with resilient, discrete beads of elastic material. These may be used as protective padding to absorb the force of an impact and to protect he user from injury while allowing liquid and air to freely pass through the pad. The pads may also have a plurality of discrete, substantially solid beads of substantially inelastic waterproof, closed-cell foam wherein some outer portions of adjacent beads abut one another and other outer portions of said adjacent beads are spaced from each other to create interstitial spaces. At leas some of the adjacent beads may be fused together at the abutting, outer portions thereof. Other suitable pads for use in the present invention are disclosed in U.S. Pat. No. 20030077407 and U.S. Provisional Application No. 60483, 995, entitled "Protective Padding filed Jul. 1, 2003 are incorporated herein by reference in their entirety.

Other suitable padding may include fluid-containing pads. In one alternative embodiment, the cap member (2) may comprise one or more fluid-containing pads (7). The fluid-containing pads (7) are flexible, resilient and shock absorbent. The thickness of such pads may range from 0.20 inches to 6.0 inches. However, it should be understood that the thickness of the pads may vary in accordance with the desired yeildability or stretchability of the pad.

Each fluid-containing pad (7) contains a fluid (3) in the nature of a liquid, thus enabling the pad to flex and become fitted to the contours of the wearer's head. In one alternative embodiment, one or more pads may be filled with air, instead of fluid. In a preferred embodiment, the fluid-containing pad (7) is at least substantially filled to capacity with the fluid. In some instances, the fluid-containing pads may be less than substantially filled to capacity. This allows a certain degree of compressibility of the entire volume of the pad upon impact. But even in the cases where the pads are entirely filled with liquid or air, there would be a certain amount of yieldability of the pads because of the elasticity of its outer skin, (15).

The fluid (3) inside the pads (7) may be any fluid, such as water or any other non-toxic material. Such fluid (3) may also include any gelatinous fluid or any other viscous liquid that is of sufficient density or viscosity to provide protective benefits to the wearer's head upon impact due to falls or bumps against hard objects. Such fluids may include, but are not limited to, any silastic gelatin material or any other material containing polymeric silicones. The fluid (3) inside the fluid-containing pads (7) may also comprise a mixture of water and glycerin in about equal proportions or in a range between 30% and 70% glycerin and the remainder water, or other liquids such as syrups or similar viscous materials, grease or gels.

In the present invention, the one or more pads may comprise any shape, including but not limited to, squares, triangles, or rectangles. The pads may also be spherical, cylindrical, conic, or disc-like, among other shapes and sizes. In one alternative embodiment, the pads may be one or more difference shapes or sizes. Further, the one or more pads of the present invention may be disposed in cloth fabric. Such fabric may be of any pattern, print, or color. It may be of cotton, nylon, Dacron, silk, or any other similar material. The cloth may be hemmed on at least one edge, or up to four edges. Light cotton is an example of a preferred fabric. The pads may be cut in a variety of shapes appropriate to fit the top, sides, or forehead of the person wearing the protective hat.

B. Composite Protective Pad

In another alternative embodiment, the one or more pads may comprise a padded composite (e.g., padded sandwich). The padded composite may be flexible and shock absorbent. It may also comprise an outer portion and an inner portion. The outer portion and inner portion comprising a padded material. In one alternative embodiment, the padded material of the outer portion is different from that of the inner portion. Such material may include any material capable of providing protective benefits alone or in combination with other materials, including, but not limited to, foam, rubber, soft plastic, fabric, or any of the pads described herein.

In one alternative embodiment, the padded composite may comprise a gel layer (e.g. fluid containing pad) positioned between another material, or vice versa. Traditional gels may have weight issues that are not desirable in headgear. The sandwiching of gel material between foam (or vice versa) can reduce the weight of the padding, while providing sufficient protection against bumps and bangs. A gel-foam composite replaces some of the foam material otherwise required for sufficient padding. Also, there are aspects of foam padding preferable over gel padding in terms of shock attenuation. There are aspects to gel padding (e.g., fluid-containing pad) preferable over foam in terms of shock distribution during impact as well. By combining foam padding and gel padding, the benefits of both components may be obtained. A non-limiting example of a gel-foam sandwich is illustrated in FIGS. 6*a*–6*b*. Here, the gel layer (19) is positioned between foam layers (20) and (21). The gel-foam composite may also comprise a foam layer positioned between gel layers. In another alternative embodiment, the gel layer may be positioned between a rubber or rubber-like layer, or vice versa.

The gel layer may comprise any suitable gelatinous or viscous fluid described herein or any other liquid that is of sufficient density or viscosity to provide protective benefits to the wearer's head upon impact due to falls or bumps against hard objects. Such fluids may include, but are not limited to, any silastic gelatin material or any other material containing polymeric silicones. Suitable gel composites can be made by methods known to those skilled in the art.

C. Outer Skin

In the present invention, the one or more pads may comprise an outer skin. The outer skin (15) of the one or more pads may be made of a resilient material of suitable durability such that it holds the padding and will not rupture upon light to moderate impact due to the wearer banging or bumping his head on a hard object. In one alternative embodiment, the outer skin (15) may comprise a resilient material including but not limited to mylar, vinyl plastic polyurethane, a blend of vinyl-polyurethane or the like. The outer skin (15) may also be waterproof so that it will not spoil upon multiple washings of the present invention either by hand or in a washing machine.

D. Position of Pads

In one alternative embodiment of the present invention, multiple pads may be positioned in a regular and spaced assembly, wherein the pads are generally equidistant from each other. (E.g., FIGS. 3A and 3B). The assembly of the pads may also comprise multiple pads interconnected and positioned in irregular intervals. In another embodiment of the present invention, multiple pads may be positioned to form meshes of varying sizes and shapes therebetween. If desired, one single pad may be utilized in the construction of the present invention provided that it adequately protects the wearer's head.

In another alternative embodiment, some pads may be interconnected, as opposed to being positioned separately from other pads utilized in the construction of the present invention. For example, the head protector of the present invention may comprise multiple pads interconnected to each other or it may comprise a combination of non-interconnected pads and interconnected pads. In another alternative embodiment, the pads are substantially uniformly distributed along the inner surface (16) of the cap member (2).

In another alternative embodiment of the present invention, the one or more pads are positioned such that they cover one or more portions of the entire inner surface (16) of the cap member (2) or at least a substantial portion thereof. It should be understood, however, that the present invention is not limited to any specific number or sizes of pads or assemblies thereof. Rather, any number, size or assembly may be utilized in the construction of the present invention, so long as the pads adequately protect the wearer's head from injuries due to falls or bumps against hard objects, for example.

E. Outer Surface of Cap Member

The cap member (2) may further comprise an outer surface (8) of pliable material. Examples of suitable material for the outer surface (8) of cap member (2) include, but are not limited to cotton, linens, knits, woven and non-woven fabrics, or any combination thereof. Other suitable fabrics may include an absorbent, towel-like fabric that is substantially stretch resistant, such as terry. Such terrys may include but are not limited to single and double faced terry, Turkish terry, French terry, boucle, velour or baby terry, or any combination thereof. The pliable material of the outer surface may also comprise an insulating fabric, including, but not limited to wool, microfiber, fleece, ultra suede, felted fabrics, padded fabrics, thinsulate, or any combination thereof. Other suitable fabrics may also include water repellant fabrics, such as, for example, Gortex™, nylon, plastic, rubber, Teflon™, or any combination thereof. Fabrics treated with a water repellent coating may also be suitable. Additional suitable fabrics may include silk, rayon, mesh, leather, velvet, cashmere, camel hair or any combination thereof.

The cap member (2) may be structured so that it fully encloses and/or encapsulates the one or more pads, thereby concealing the pads from view. This gives the head protector an appearance of a fashionable hat worn by either an infant, child or adult. In one alternative embodiment, the pads may be enclosed or encased between the outer surface (8) and inner surface (16) of cap member (2). This can be achieved, for example, by engaging the outer surface (8) and inner surface (16) to form a space therebetween in which the pads can be positioned. In this instance, for example, the edges of the outer surface (8) and inner surface (16) may be sewn together to from a pocket in which the pads can be placed. Alternatively, the pads may not be encased between the outer surface (8) and inner surface (16) of cap member (2). Instead, the pads may be positioned underneath the outer surface (8) of the cap member (2) so that the pads contact the wearer's head directly, or the pads may be covered by another material positioned beneath outer surface (8) and/or on top of inner surface (16).

In another alternative embodiment, the present invention may comprise an assembly of pads whereby the assembly itself gives a fashionable and pleasant appearance when worn thus eliminating the need to incorporate cap member (2) in the construction of the present invention. An example of such an embodiment would include an assembly of pads resembling a lace pattern.

F. Chin Strap

In another alternative embodiment of the present invention, the cap member (2) has strap (10) for securing the head protector (1) on the wearer's head. The strap (10) comprises a first end (11) and second end (12), not shown. The first end (11) is affixed to the first side (13) of the cap member (2). The second end (12), not shown, is affixed to he other side (14), not shown, of cap member (2) The strap (10) may comprise an elastic or non-elastic material, including but not limited to leather, canvas, cotton or lycra.

Alternatively, strap (10) may be affixed to the lower area of hat (1). The strap (10) may be affixed to head protector (1) by using VELCRO™ type material, buttons, or any suitable means for removable affixing the chin strap (10) thereof. Chin strap (10) may also permit adjustment of the size of the band to accommodate different sized head.

The chin strap (10) may also have a closing member (18), including but not limited to snaps or a velcro closing member. The closing member may comprise two strips of material attached to the end portions of the chin strap at the rear of hat (1). The sizing straps may connect the two strips at a desired setting of the wearer by sticking together and maintaining the length of each strap set by the wearer.

G. Ear Flap

In another alternative embodiment of the present invention, a protective ear flap (17) is removable and/or adjustably connected to each side of protective hat (e.g., cap member (2)). Each protective ear flap may comprise one or more pads covered by a pliable material, such as those described herein. Ear flap (17) will be large enough to sufficiently cover and/or protect the wearer's ears from elements of the weather or injury. Flap sizes with respect to width or diameter may vary depending upon whether or not they contain fluid-containing pads, although their shape are preferably spherical or circular. Protective ear flap (17) may be attached to the protective cap member at the sides or top of hat (2) by any known means in the art, including but not limited to using attached strings or straps to tie in a bow or cooperating snap means or VELCRO™ positioned at or near the sides or top of the hat.

H. Sizing Strap

In another alternative embodiment of the present invention, a sizing strap (4) (e.g., a velcro sizing strap) may be positioned on the outer surface (8) of the cap member (2). The sizing strap may encircle the cap member (2) along its base. The sizing strap may be positioned along either the inner surface (16) or outer surface (8) of the cap member (2). The sizing strap may be extended or reduced in size by utilizing a double strap sizing mechanism which could comprise but is not limited to Velcro. The sizing strap may extend from two narrow aperatures in the outer surface at the rear of hat (1). The sizing strap can be manipulated by the wearer to best fit his/her head size by folding one strap on top of the other or sliding one strap along the other and securing it with a fastening means, including but not limited to velcro, or snaps. The sizing strap may be made of a material that differs from the fabric of the protective hat (1) and may or may not be covered on the exterior side of the strap with the same fabric covering the outer surface (8) of the cap member (2).

I. Protective Liner

In one alternative embodiment, the protective hat may comprise one or more pads assembled in the form of a protective liner for use underneath a hat, or the lining may be worn by itself. The liner may be removably attached to the inner surface of a hat, or it may be affixed thereto. In another embodiment, the protective hat comprises a non-removable liner. The liner may have size adjustment mechanisms in the form of straps or drawcords which fasten with velcro, buttons or hook and loop closures, for example. The size adjustment mechanisms are at the rear or under the chin area of wearer's head. In one embodiment, the liner may comprise a series of rows of pads, arranged in a manner so as to be at least substantially uniformly distributed along the inner surface of the head protector. In some embodiments, one or more pads may be entirely separate, that is, not in communication with other pads. In another alternative embodiment, some pads may be in communication with each other and some may not. The liner may comprise a material which surrounds or connects the padding of the liner. Such material may include, but is not limited to, and the interior of the protective hat may comprise cotton, polyester (including Capilene (R)), lycra, spandex, nylon, fleece (including microdenier and PCR (R)), Gortex(TM), plastic, rubber, polyester fleece (Polartec (R) Power Dry (R)), Teflon(TM), linen, knits,woven and nonwoven fabrics, silk, rayon, mesh, leather, velvet, terry, cashmere, camel hair. Materials may be treated with water repellant finishes such as Deluge (DWR) durable water repellant or H2No (R) (Highly Breathable) waterproof/breathable barrier, for example.

In another alternative embodiment there is a liner construction for the head protector of the present invention. The liner may be in the form of one or more pads filled with an appropriate medium. For example, the pads may be filled with liquids or air to provide comfort when worn, plus resistance against impact. The liner may also comprise a plurality of pads. The pads may be at least partially filled with a medium, e.g., fluid. The pads may be round, annular shape, or triangular shape. The pads may be interconnected by a plurality of tubes. The tubes having a relatively small diameter interconnecting at least certain of the pads for restricting the rate of flow of fluid between pads so as to make the liner relatively incompressible and thus afford protection to the wearer's head upon impact. The liner may also comprise any of the padded materials, structures, assemblies, or composites described herein, such as interconnected gel-foam, for example.

J. Safety Reflectors and Accessories

In another alternative embodiment, the head protector of the present invention may comprise one or more safety reflectors affixed thereon. In one alternative embodiment, one or more safety reflectors may be incorporated or affixed on the outer surface of the head protector. For example, a snapable or otherwise removable safety reflectors may be attached to the outer surface of the head protector. Reflectors which reflect light impinged upon them are well-known and used for many purposes, primarily to alert on-coming motorists of the presence of pedestrians, for example. In one alternative embodiment, one or more safety reflectors may be affixed to the head protector of the present invention. The reflective material may be, for example, any one of number of different commercially available reflective paints or materials, which will reflect light impinged upon it. The reflective material may be affixed to the head protector by means of a snap, Velcro, clip or it may be imbedded in the out surface of the head protector.

In another alternative embodiment, the head protector may have a strap or cord at the top to be used by doctors or physical/occupational therapists to assist an individual in holding up his/her head during therapeutic activities. The protective hat of the present invention may also comprise playful decorations or accessories (such as animal ears, antennae, tails, team logos, cartoon or storybook characters, etc.). Such hats may also have pieces of fabric which hang down from bottom of the rear of the hat to block the wearers neck from the sun. Preferably, these items would be soft or flexible such that they would not cause harm to the wearer upon impact.

The protective hat of the present invention may comprise one or more pockets or any other receptacle, cavity, pouch or opening to hold small articles. For example, the pocket may be adapted to hold an identification card containing information about the wearer. This is important in the event the wearer gets disoriented or lost. Such is common among cognitively impaired individuals. The pockets may be adapted to hold other items, such as tissue. The pocket may comprise means for opening and closing the pockets, such means may include snaps, buttons, zippers or velcro.

K Users of Protective Hat

The present invention may also be useful to protect the head of the infirm or an aged individual who is in danger of falling while walking or standing. For example, the protective hat of the present invention may protect the heads of individuals with medical conditions or physical disabilities rendering them prone to falls as a result of compromised balance or strength. Individuals suffering from strokes or those who have recurring seizures, multiple sclerosis, Parkinson's diseases or certain neuropathological conditions would benefit from the protective hat of the present invention because it would reduce their risk of injury. Moreover, elderly people or those who are weakened or experience orientation problems due to the symptoms or treatments of other illnesses would also find use for the protective hat of the present invention. With respect to individuals with illnesses or disabilities, the present invention would be a desirable change from the currently available protective devices or helmets which are more bulky, restrictive and unfashionable.

In addition, the protective hat of the present invention is suitable for individuals suffering from sensory perception, balance, strength or coordination problems. Included among these are the following illnesses and disabilities: cerebral palsy, spina bifida, hydrocephalus, cerebrovascular accidents, seizure disorders, (e.g. Epilepsy), sensory integration disorders, pervasive developmental disorders (autism, etc.), gait disorders, hemiplegia, diplegia, quadriplegia, athetosis, stroke, Parkinsons disease, traumatic brain injury, blindness and visual impairment, multiple sclerosis, amputees, congenital conditions, spinal cord injuries and other neurological or neuromuscular disabilities, muscular dystrophy, Rett Syndrome, spinal muscular atrophy, Angelman Syndrome, arthrogryposis multiplex congenita, Dandy-Walker Syndrome, mitochondrial myopathy, or severe Attention Deficit Disorder and any other debilitating illnesses.

The protective hat of the present invention is also suitable for individuals suffering from Neurologic Movement Disorders, including but not limited to, Ataxia, Corticobasal, Degeneration, Dyskinesias (Paroxysmal), Dystonia (general, segmental, focal); including blepharospasm, spasmodic torticollis (cervical dystonia), laryngeal dystonia (spasmodic dysphonia), oromandibular dystonia, Essential Tremor, Hereditary Spastic Paraplegia, Huntington's Disease, Multiple System Atrophy, (Shy-Drager Syndrome), Myoclonus, Parkinson's Disease, Progressive Supranuclear Palsy, Restless Legs Syndrome, Rett Syndrome, and Spasticity—due to stroke, cerebral palsy, multiple sclerosis, spinal cord or brain injury Sydenham's Chorea, Tardive Dyskinesia/Dystonia, Tics/Tourette's Syndrome, and Wilson Disease.

Thus, the protective hat of the present invention may be utilized by the above-mentioned individuals to reduce the risk of head injury during a fall and to alleviate the their fear of falling while conducting daily activities. The present invention may also provide these individuals an enhanced sense of confidence and motivation to conduct daily activities due to the protective nature of the present invention.

L. Disabilities/Teaching Device

An article in the Southern Medical Journal entitled "Protective Helmets for Children with Special Health Care Needs" by Dr. Raphael Sneed and Christine Stencel (May 2001 vol. 94, No. 5) discusses the need for protective helmets for medical purposes. The article discusses how helmets are currently used for children who require protection from self multilation and as orthotic devices for motor impaired children who need assistance performing normal activities. The article states that there is little research in the medical literature with regard to the need for helmets for medical purposes. Based upon informal research in the form of interviews with medical professionals, the article speaks to the need for protective helmets for medical reasons such as seizures (particularly the atonic type), unsafe gait (e.g. cerebral palsy), brain injury, mental retardation, visual impairments, impaired coordination and cranial defects, among others.

The article raise the consideration of possible adverse psychological or emotional consequences for patients who are prescribed helmets for medical purposes because of the fact that current helmets prescribed for medical purposes are "ugly headgear" and invite the stigma of an "institutionalizing" apparatus. In addition, a small study of ten children who wore custom made helmets for cranial defects because they were at risk for secondary brain trauma revealed that patients complained primarily about the heat and odor caused by the lack of ventilation.

The head protector of the present invention is designed to have an attractive appearance in that it looks like an everyday hat as opposed to a medical or orthopedic device for a person with disabilities. It differs from existing protective helmets in that it has a soft exterior made of a variety of fabrics and materials, for example. Further, the construction of the head protector allows for open spaces in certain areas of the head protector (e.g. protective lining) to ensure ventilation. The head protector may also use fabrics and materials currently utilized in the construction of sports and outdoor apparel which have been created to allow heat and perspiration out and fresh air to enter. The present invention also has a removable protective lining so that it can be worn under multiple hats in a variety of social and/or therapeutic settings.

Further, children or adults who are disabled, developmentally delayed or who suffer from neuro motor or muscular/skeletal impairments often have difficulty standing and/or walking independently, or accomplishing any other everyday activity. These people often require physical and occupational therapy. Physical therapy involves activities designed to increase, restore or maintain an individual's range of motion, physical strength, flexibility, coordination, balance and endurance. Physical therapists recommend assistive devices to prevent injury and promote safe, independent physical activity.

The present invention may be suitable in an environment where individuals need head protection while performing physical therapy and everyday activities. Occupational therapy helps people who are physically, mentally, or developmentally disabled improve their functioning in daily living and working environments. For example, disabled individuals learn how to bathe, prepare food, perform household tasks and necessary activities at work. Occupational therapists instruct individuals with disabilities in the use of adaptive equipment which enables them to perform a wider range of activities. Thus, the protective hat of the present invention may be utilized as a tool to reduce risk of injury of an individual undergoing physical or occupational therapy or performing everyday activities. As such, it allows for an increased level of concentration and motivation as well as an elevated sense of confidence for such therapies due to its protective characteristics. For example, a physical or occupational therapist can work more efficiently with a patient wearing the present invention as it can allow for a sharper focus on the therapeutic activity as opposed to concerns and efforts to prevent head injuries due to patient's illness or disability. Patients in turn, may experience an enhanced sense of confidence and motivation due to the protective nature of the present invention.

Accordingly, the present invention may be used as directed to an apparatus for assisting an individual to assist an infant, small child, senior or a disabled person to learn to stand or to walk, or conduct any other daily, routine activity. Such apparatus may comprise a protective hat of the present invention. Also, the present invention is directed to a method of assisting an individual to assist a disabled individual to learn to stand, or to walk or to conduct any other routine activity. Such method comprising the steps of placing a protective hat of the present invention on the head of the disabled person, while the individual is assisting the disabled individual.

The present invention may be suitable for senior citizens. Many seniors fear falling while conducting daily, routine activities. For good reason. It has been reported that one third of seniors over 65 fall each year. Of those, 50% fall repeatedly. The fear of falling is both the cause of the falls and a consequent of falls. Consequently, seniors become less mobile and more sedentary because they often have negative thoughts about falling. The protective hat of the present invention may be utilized by seniors to reduce the risk of head injury during a fall and to alleviate the fear of falling while thy conduct daily activities. As such, the present invention would provide seniors and enhanced sense of confidence and motivation to conduct daily, routine activities due to the protective nature of the present invention.

The present invention may also be adapted to protect an individual from self mutilation injuries to the head. For example, it is known that some autistic children are prone to self mutilation activities such as head banging. Some children with Attention Deficit Disorder are more prone to accidents and injuries due to impulsivity and thus require more protection from falls and bangs against hard objects.

M. Work Environment

Further, the protective hat of the present invention may also be worn in work environments where there is a risk of minor head injury due to bangs against people, debris or objects such as low hanging pipes or machinery or falls due to slippery or obstructed walkways, for example. The present protective hat may used as an alternative to the conventional "hard-hat" made of solid plastic material. Hard-hats are typically uncomfortable, and are not fashionable. In one alternative embodiment, the present protective hat may comprise a soft, pliable outer surface comprising one or more pads described herein. In one alternative embodiment, the present protective hat may be worn in a work environment, including, but not limited to factories, warehouses, construction sites, repair sites, auto shops, garages, offices, gardens and other environments. In another alternative embodiment, the present invention may be worn in a low impact work environment where there is no substantial risk of severe head injury, e.g., life threatening head injuries or severe head trauma, but there is a risk of minor head injury, such as minor bumps or bangs.

While the present invention has been described in connection with the embodiments described herein, it will be understood that the present invention is capable of further modifications, and this application, including the appended claims, are intended to cover any variations, uses, or adaptations of the present invention following, in general, the principles of the present disclosures set forth herein and including such departures from the present disclosures that come with known or customary practices in the art to which the invention pertains. Also, the invention may suitably comprise, consist of or consist essentially of the elements or steps described herein. Further, the invention described herein suitably may comprise or be practiced in the absence of nay element or step which is not specifically disclosed herein. Further, one or more steps described herein may be performed simultaneously with another step.

I claim:

1. A protective hat free of a solid, continuous outer shell for everyday wear during non-sport activities by infants, small children, senior citizens or physically disabled adults, comprising: (i) one or more pads having a top rigid portion and soft bottom portion, said rigid portion being flexible, resilient and shock absorbent; (ii) a fabric layer for receiving the one or more pads therein, such that said pads are interdispersed within the fabric layer, wherein the soft bottom portion of the one or more pads is positioned against the wearer's head when the protective hat is worn; (iii) the rigid outer portion of the one or more pads comprising a material adequate to protect the wearer's head from injury resulting from bumps, falls or slips during non-sport activities; (iv) the fabric layer being encased within an outer layer consisting of a pliable material; (v) the protective hat, when worn, is adapted to be worn by an infant, small child, senior citizen, or physically disabled adult, the physically disabled adult having a medical condition, the symptoms of which compromise the adult's balance or strength rendering the adult prone to falls when walking or standing; (vi) the protective hat being so constructed such that the hat, when worn, is adequate to protect the wearer's head from injury resulting from bumps, falls or slips while standing, crawling or walking during non-sport activities; and (vii) the protective hat being free of a solid, continuous outer shell and is suitable for everyday wear during non-sport activities by infants, small children, senior citizens or physically disabled adults.

2. The protective hat of claim 1, wherein the material of the top portion and bottom portion of the one or mare pads; the padded material of the outer portion is different from that of the inner portion.

3. The protective hat of claim 1, wherein the bottom portion of the one or more pads comprises a polyethylene foam material.

4. The protective hat of claim 1, wherein the top portion of the one or more pads comprises a rubber material.

5. The protective hat of claim 1, wherein the top portion of the one or more pads comprises a closed-cell foam material.

6. The protective hat of claim 1, wherein the one or more pads comprises an open-cell foam material.

7. The protective hat of claim 1, further comprising a chin strap for securing the protective hat about the head of the wearer; the chin strap having a first end and second end, the first end being connected to a first side of the protective hat and the second end connected to a second side of the protective hat.

8. The protective hat or claim 1, wherein the one or more pads are substantially uniformly distributed along the wearer's head when the protective hat is worn.

9. The protective hat of claim 1, wherein the one or more pads are non-interconnected relative to each other.

* * * * *